US005915607A

United States Patent [19]

Newboult, Jr.

[11] Patent Number: 5,915,607

[45] Date of Patent: Jun. 29, 1999

[54] SIDE HANDLE BATON HOLSTER APPARATUS AND METHOD

[76] Inventor: Robert E. Newboult, Jr., P.O. Box 685, Avon Park, Fla. 33826

[21] Appl. No.: 08/969,751

[22] Filed: Nov. 13, 1997

[51] Int. Cl.[6] ..... B26B 29/02

[52] U.S. Cl. ..... 224/232; 224/242; 224/251; 224/914

[58] Field of Search ..... 224/251, 242, 224/243, 914, 911, 904, 232, 234, 674, 675; D3/228, 229

[56] References Cited

U.S. PATENT DOCUMENTS

| | | | |
|---|---|---|---|
| D. 257,410 | 10/1980 | Rink | D3/228 |
| D. 258,248 | 2/1981 | Tillman | D3/228 |
| 2,410,640 | 11/1946 | Engle | 224/197 |
| 3,227,337 | 1/1966 | Santo, Jr. | 224/251 |
| 5,551,610 | 9/1996 | Clifton, Jr. | 224/197 |
| 5,622,295 | 4/1997 | Hellweg et al. | 224/193 |

*Primary Examiner*—Allan N. Shoap
*Assistant Examiner*—Maerena W. Brevard
*Attorney, Agent, or Firm*—William M. Hobby, III

[57] ABSTRACT

A holster for a side handle baton is formed from a single blank of leather or plastic. The blank is formed and stitched to provide a belt loop and a flared open ended pocket having an axis at an angle with the horizonal. The blank may be folded to provide a left hand or right hand holster. A notch in the upper edge of the pocket accepts the side handle when a baton is inserted to prevent rotation of the baton, and the baton forms a friction fit with the lower open end of the pocket. The method provides for making a baton holster with a unitary blank folded and fastened to form either a left hand or right hand holster.

4 Claims, 1 Drawing Sheet

SIDE HANDLE BATON HOLSTER APPARATUS AND METHOD

BACKGROUND OF THE INVENTION

The present invention relates to holsters and more particularly to a holster for a policeman's side handle baton which orients the baton to permit rapid, one hand withdrawal and to a method of making a baton holder.

Over recent years, the side handle baton has been widely adopted by law enforcement bodies. Typically, such batons have bodies of about 24 inches in length with a side handle about six inches in length extending at right angles to the body portion, producing a straight handle of about 6–8 inches in length.

A number of designs of holsters for the side handle baton are known in the prior art. U.S. Pat. No. 4,662,552 to Uychara teaches a cylindrical sleeve pivotally attached to a belt and having a notch to accept the side handle. A friction pivot permits changing the angle of the sleeve with respect to the belt to accommodate various activities of the user. Bingham, U.S. Pat. No. 4,355,804 and No. 4,424,923, disclose a baton carrying ring attached to a belt. The baton has a hook and trigger device recessed into the body. U.S. Pat. No. 4,694,981 to Miller, Jr. shows a ring for attachment to a belt and having an upward projecting post and allen wrench to prevent a side handle baton from rotating when the baton is inserted into the ring.

An important aspect of the means of carrying a side handle baton is the ability of the user to quickly remove the baton with one hand and to return the baton to the carrying mode quickly. Prior art holsters often require the use of both hands to either remove or insert the baton. Ring type holders require the long baton to be drawn out essentially vertically in an awkward motion. Several of the above referenced prior art patents require operation of catches or the like when drawing or replacing a baton.

There is therefore a need for a side handle baton holster which will maintain the baton at an angle which permits withdrawal in a position for immediate use with one hand, and which permits a quick return of the baton to the stowed condition.

SUMMARY OF THE INVENTION

The present invention is a holster for a side handle baton formed from a single piece of leather or similar material. A blank is cut having a vertical oriented rectangular portion and an angularly directed portion extending downwardly therefrom. The rectangular portion is folded over and stitched to form a belt pocket. The angular portion is folded over and stitched to form a slightly flared pocket having an axis at an angle of 30° to 45° with respect to the horizontal. Advantageously, the blank may be folded to form either a right hand holster or a left hand holster to accommodate either a right handed or left handed user.

The holster is disposed on the user's belt and positioned at the side with the lower pocket portion angled toward the rear. The baton has its long body end inserted into the pocket portion with the side handle toward the rear. In some instances, a right handed user may position the holster on the left side. To withdraw the baton, the user reaches across his body with his right hand and slides the baton from the holster ready for use. However, other right handed users may prefer to draw the baton from the holster on the right side. When in the holster, the lower end of the baton is clear of the user's leg and will not interfere with walking or running.

The flared pocket of the holster permits the user to return the baton to the holster with one hand and without the necessity of looking at the holster.

It is therefore an object of the invention to provide a holster for a side handle baton which holds the baton at an angle with the vertical such that the baton may be quickly withdrawn with one hand, in a single motion, with the weapon ready for immediate use, and returned to the holster quickly with one hand and without looking at the holster.

It is another object of the invention to provide a side handle baton holster formed from a single blank of material, such as leather, that can be configured for a left hand or a right hand user.

It is still another object of the invention to provide means for carrying a side handle baton when not in use which permits normal activity and which permits rapid access of the baton by the user.

A method of making a baton holster includes making a unitary blank shaped as set forth in the apparatus and folding and fastening the blank on one side for a right hand holster and the other side for a left hand holster.

These and other objects of the invention will become apparent from the following description when read in conjunction with the drawings.

DETAILED DESCRIPTION OF THE PREFERRED EMBODIMENT

Figure 1:
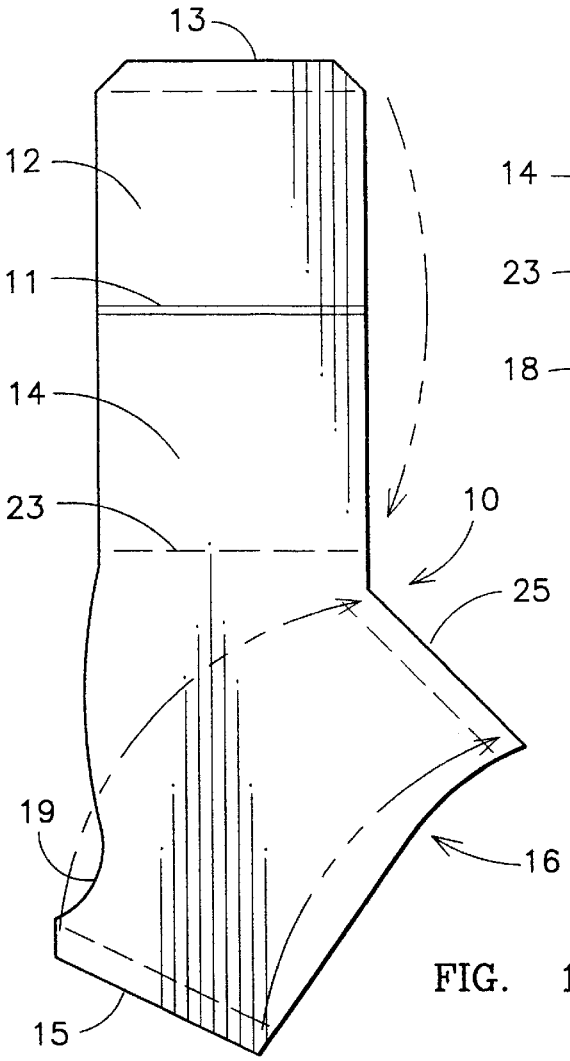
FIG. 1 is a plan view of a blank from which a side handle baton holster is formed in accordance with the invention.

Referring to FIG. 1, a blank 10 is cut from a sheet of resilient material, preferably leather. However, other materials such as plastic are also suitable. Blank 10 includes an upper rectangular section 12, a central rectangular section 14, and a lower, irregular section 16. Sections 12 and 14 are connected by a fold line 11. To form a belt loop 30 for the holster, section 12 is folded back on itself along line 11 as shown by arrow A and the distal edge of section 12 is stitched to section 14 along stitch line 23. Lower section 16 includes a curved edge 21 having a concave region 19 and is formed to provide opposite edges 15 and 25, both at an angle with respect to the vertical edges of sections 12 and 14. Edge 15 is folded forward, as indicated by arrows B, and stitched to edge 25 to form a pocket.

Figure 2:
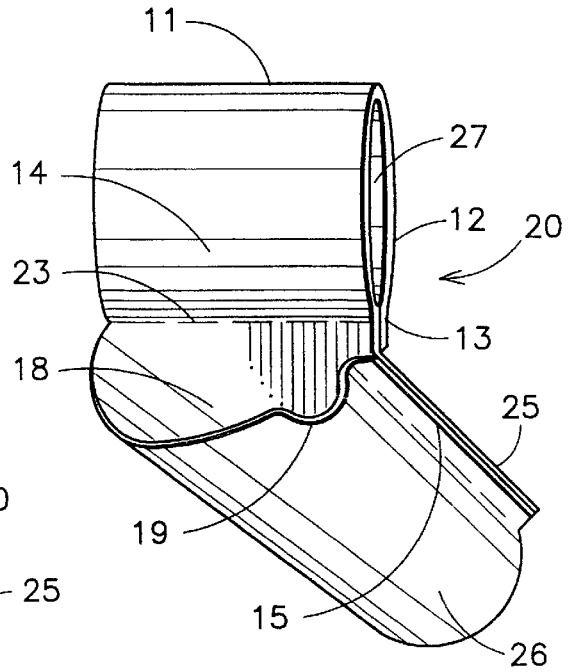
FIG. 2 is a holster formed from the blank of FIG. 1.

FIG. 2 provides a perspective view of a holster 20 formed from blank 10 of FIG. 1. As will be noted, upper section 12 has been folded back along fold line 11 and the upper edge thereof fastened along stitch line 23 to the lower edge of lower section 14. Preferably, fastening is accomplished by stitching but other fastening means, such a riveting and cementing, may be used. The above described operation provides a belt loop space 27 to permit holster 20 to be attached to the user's belt. Lower section 16 has been folded forward and edge 15 stitched or otherwise fastened to edge 25. The shape of lower section 16 is selected to provide a tapering pocket 26 with opening 18 for a side handle baton. The axis of pocket 26 is at an angle in the range of 30° to 40° with respect to the axis of the belt loop. The blank 10 may be turned over from the view of FIG. 1 and the folding of sections 12 and 16 reversed to provide a holster for left handed handling of a side handle baton.

Figure 3:
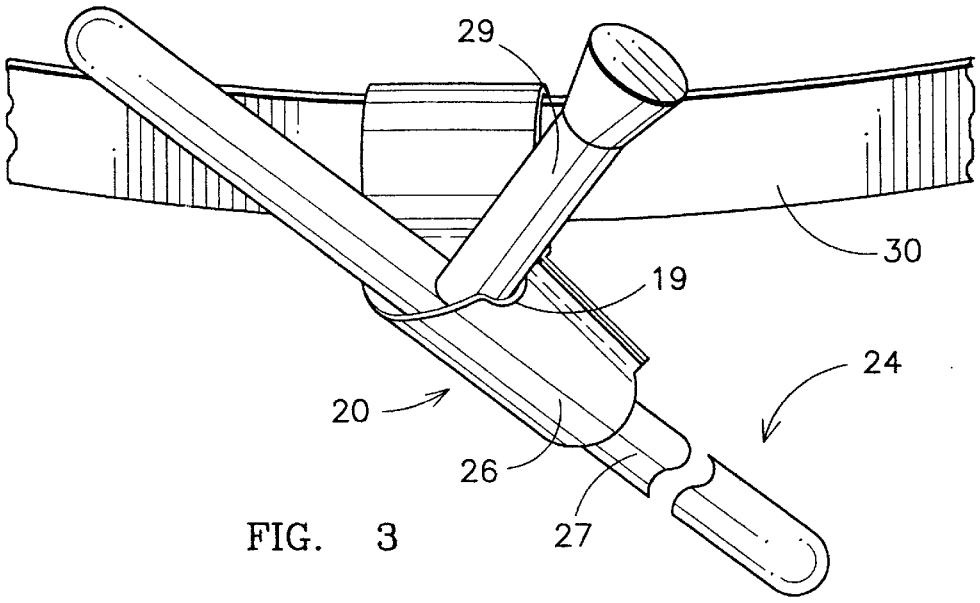
FIG. 3 shows the holster of FIG. 2 installed on a belt.

Turning to FIG. 3, a perspective view of holster 20 installed on a belt 30 has a side handle baton 24 in a normal holstered position. The lower end of pocket 26 is formed to provide slight friction to the lower portion 28 of baton 24 to prevent accidental dislodgment of baton 24. Handle 29 of baton 24 rests in concave region 19 of pocket 26 to prevent rotation of baton 24 while in the holstered position.

Although a specific design of the baton holster of the invention has been disclosed for exemplary purposes, various modifications may be made to the holster without departing from the spirit and scope of the invention.

I claim:

1. A method of making a side handle baton holster for permitting fast draw and fast holstering of a baton comprising the steps of:

making a unitary blank of resilient sheet material having a vertically oriented rectangular upper portion, and an angularly directed irregular portion;

forming a belt loop from said unitary blank by folding said rectangular portion downward and attaching a distal upper edge thereof to said blank;

forming either a left or right hand side pocket from said unitary blank by folding said irregular lower portion on one side for a left side handle baton holster or on the other side for a right side baton holding holster and fastening one edge thereof to another edge thereof, said pocket being formed to hold a baton at an angle with respect to a horizontal axis of said belt loop and said pocket having a flared upper opening thereof for accepting a lower end of said baton and a lower opening having a friction fit with said lower end of said baton; and forming a notch in an upper edge of said unitary blank for accepting a side handle of said baton for prevention of rotation thereof.

2. The method as recited in claim 1 including making a unitary blank of leather.

3. The method as recited in claim 1 including making a unitary blank of plastic.

4. The method as recited in claim 1 including folding said blank to form an angle between 30° and 45°.

* * * * *